US005386601A

United States Patent [19]

Köhl

[11] Patent Number: 5,386,601

[45] Date of Patent: Feb. 7, 1995

[54] FOLDING BED

[76] Inventor: Bernd Köhl, Diehlmannsweg 14, 63667 Nidda, Germany

[21] Appl. No.: 140,105

[22] PCT Filed: Apr. 29, 1992

[86] PCT No.: PCT/DE92/00341

§ 371 Date: Oct. 26, 1993

§ 102(e) Date: Oct. 26, 1993

[87] PCT Pub. No.: WO92/19134

PCT Pub. Date: Nov. 12, 1992

[30] Foreign Application Priority Data

May 7, 1991 [DE] Germany ..... 4114897

[51] Int. Cl.[6] ..... A47C 19/12

[52] U.S. Cl. ..... 5/174; 5/149; 5/111; 5/202

[58] Field of Search ..... 5/111, 149, 179, 178, 5/202, 236.1, 237, 400, 411

[56] References Cited

U.S. PATENT DOCUMENTS

| | | | |
|---|---|---|---|
| 802,390 | 10/1905 | Gusdorf | 5/174 |
| 979,227 | 12/1910 | Tinkham | 5/202 |
| 1,434,100 | 10/1922 | Creasy | 5/111 |
| 1,624,950 | 4/1927 | Hoard | 5/178 |
| 2,948,905 | 8/1960 | Sevcik | 5/111 |
| 3,089,151 | 5/1963 | Sevcik | 5/149 |
| 3,116,494 | 1/1964 | Bennett et al. | 5/411 X |
| 3,135,971 | 6/1964 | Haller | 5/411 |
| 3,295,149 | 1/1967 | Hall | 5/149 |
| 3,755,832 | 9/1973 | Bennett | 5/149 X |
| 4,048,683 | 9/1977 | Chen | 5/174 X |

FOREIGN PATENT DOCUMENTS

| | | | |
|---|---|---|---|
| 933572 | 8/1963 | United Kingdom | 5/111 |

*Primary Examiner*—Michael F. Trettel
*Attorney, Agent, or Firm*—Herbert Dubno

[57] ABSTRACT

The rectangular bed frame (1) of a folding bed is composed of two substantially symmetrical elements (2, 3), which are interconnected by hinges (4) in the symmetry plane lying between the two narrow sides (6) of the bed frame (1), so that they can fold on top of each other with their undersides. Along one of the long sides (5) both elements (2, 3) have swingable casters (15), whereupon the bed frame (1) can be easily moved during folding and transport.

9 Claims, 2 Drawing Sheets

FOLDING BED

CROSS REFERENCE TO RELATED APPLICATIONS

This application is a national phase application corresponding to PCT/DE 92/00341 filed 29 April 1992 and based, in turn, upon PCT German Application P 41 897.5 filed 7 May 1991 under the International Convention.

The invention relates to a folding bed, particularly for hotel businesses, with a frame-like rectangular bed stand and a mattress resting thereon, whereby the bed frame is composed of two substantially symmetrical elements which are interconnected by hinges in the symmetry plane between the narrow sides of the bed frame, so that they can be folded with their undersides on top of each other.

BACKGROUND OF THE INVENTION

Frequently in hotels additional beds which can be set up temporarily are needed. Such beds have to meet special requirements, since they have to be repeatedly set up and dismantled, and have to be kept in a storage space while not in use. Therefore such beds have to be easily transportable, easy to be set up and dismantled and they have to require as little storage space as possible. In order to meet these requirements, folding beds are known which with the aid of more or less complicated mechanisms can be folded to the smallest possible volume. However such beds are seldom sufficiently comfortable and their handling is so complicated that it requires two people to fold or unfold the bed.

From CH-A-516 295 a folding bed of the mentioned kind is known, which has a two-part frame, the two frame parts being swingably interconnected by hinges whose common axis of rotation lie in the symmetry plane between the narrow sides of the bed. The upper face of the frame is provided with a fabric cover serving as a mattress fastened by tension springs to the bed frame. In the folded state the bed can be carried. Hereby the undersides of the two frame parts are lying on top of each other, whereby at the same time they form a carrying container for objects.

OBJECTS OF THE INVENTION

It is the object of the invention to provide a foldable bed which can be transported, set up and dismantled by a single person and which affords a high degree of sleeping comfort without any limitations.

SUMMARY OF THE INVENTION

In accordance with the invention, this problem is solved due to the fact that both frame elements have swingable casters along one of the longitudinal sides of the bed frame, whereupon the bed frame can be moved during folding and transport. Due to the invention a bed frame is created which is of an extremely simple construction and which can be easily set up and folded by a single person. In its folded state, the bed has a compact size, so that it is easily transportable and does not require much storage space.

The invention further provides that at least one element be free and the other element be capable to stand on the floor surface with its end opposite to the hinges. An unfolding during transport is avoided according to the invention by providing a latch on the ends of the elements forming the frontal sides of the frame, thereby these elements becoming interconnectable.

According to a further feature of the invention, in order to keep the storage space as small as possible without having to lower the bed too much, the elements can have legs in a staggered arrangement, so that when folded the legs of one element come to lie next to the legs of the other element. This way the legs dip into the free space available at the underside of the bed frame, when the latter is folded. This way no additional storage space is needed for the protruding part of the legs.

In the folded state the bed can be carried. Hereby the undersides of the two frame parts are lying on top of each other, whereby at the same time they form a carrying container for objects.

This way the mattress elements can be then simply transported and stored together with the bed frame, by remaining lodged in the receiving recesses of the bed frame and being secured there. If the mattress elements are not connected to the bed frame, according to a further proposal of the invention they can be secured to the bed frame during transport by straps.

In order to be able to carry the bed if necessary, the invention further provides a carrying handle on the hinge side and on the opposite side of one or both elements.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
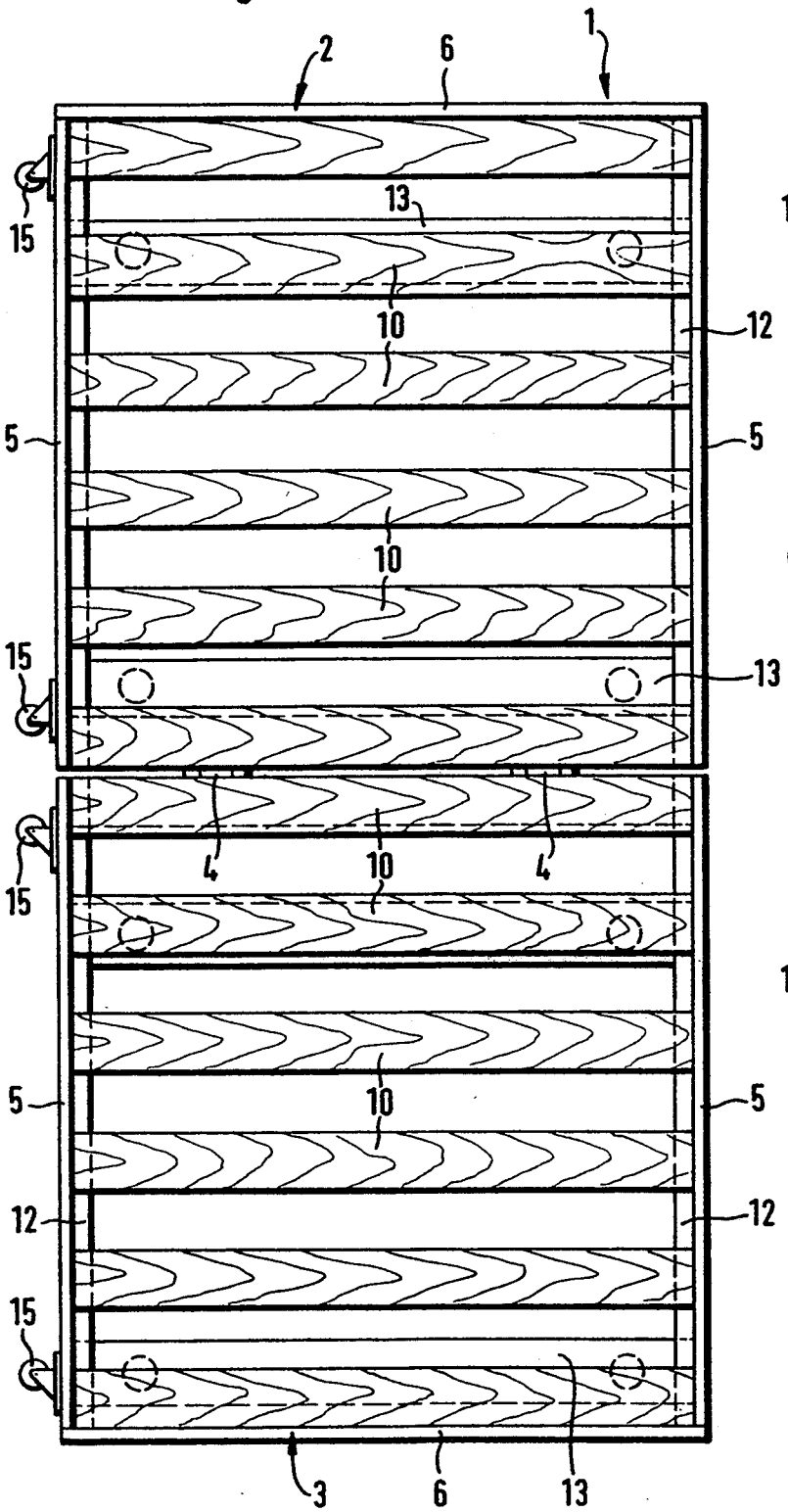
FIG. 1 is a top view of an unfolded frame of a foldable bed.
Figure 2:
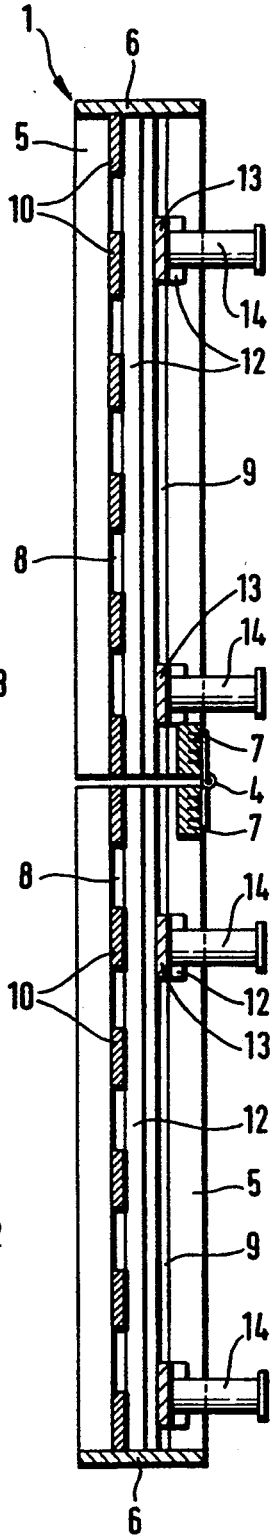
FIG. 2 is a longitudinal sectional view through the bed frame according to FIG. 1.

The shown bed frame 1 is composed of two elements 2, 3, substantially symmetrical with respect to the median plane parallel with the narrow sides and interconnected by two hinges 4. Each of the elements 2, 3 has the shape of a rectangular frame consisting of two long sides 5, a frontal side 6 and a connection brace 7 parallel to the frontal side 6. The long sides 5 and the frontal sides 6 are set up in an upright position with respect to the installation plane and are securely glued together in the usual fashion at their adjoining ends. The connection brace 7 is arranged at the lower edge of the ends of long sides 5 which are opposite to the frontal side 6 and are rigidly connected by dowel pins or screws with the long sides 5. Each of the hinges 4 is secured to the underside of the adjacent connection braces 7 of both elements 2, 3, in such a manner that the elements 2, 3 can be folded on top of each other with their undersides. In addition the underside of either side 6 or side provided with hinges is formed with a handle 20.

on the mutually facing inner surfaces of long sides 5 longitudinal grooves 8, 9 are formed at intervals. In the upper longitudinal grooves 8 engage the ends of slats 10 parallel to the frontal sides 6 arranged at intervals and which serve as a support for the mattress 11. The slats 10 are additionally fastened to corner fillets 12 which extend on the underside of slats 10 along the longitudinal grooves 8 and are glued together with the long sides 5, as well as with the slats 10. In the lower longitudinal grooves 9 two crossties 13 are fastened, each having two legs 14 on its underside. For fastening purposes the legs 14 are provided with a threaded pin screwed into a receiving nut anchored in crossties 13. The connection between the crossties 13 and the long sides 5 is also reinforced by short corner fillets 12. The crossties 13 are not arranged like mirror images in the two elements 2, 3, but are staggered so that during the folding of elements 2, 3 the legs 14 of element 2 come to lie next to the legs 14 of element 3, so that the legs 14 do not impede the folding.

On one longitudinal side of the bed frame 1, on the outside of each of the long sides 5 of both elements 2, 3, two pivotally supported casters 15 are fastened, on which the folded bed frame can be rolled away.

Figure 3:
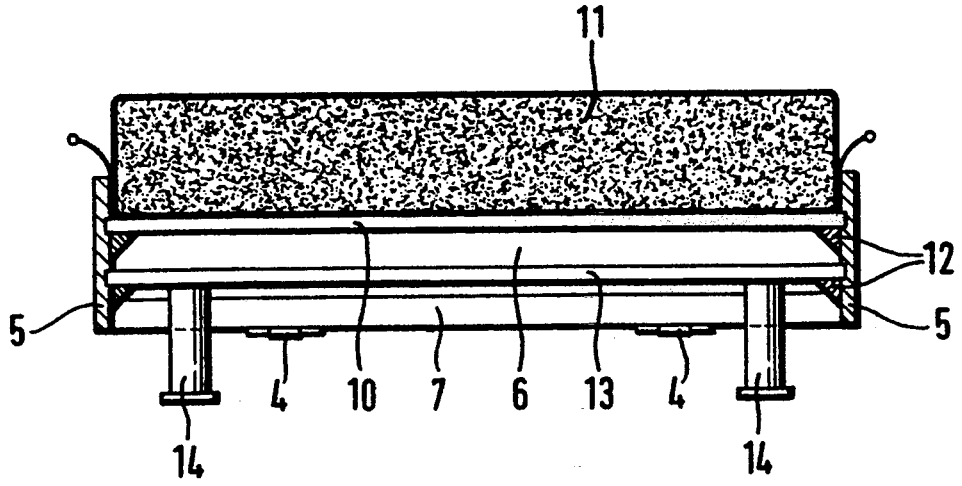
FIG. 3 is a cross sectional view through an element of the bed frame according to FIG. 1 with mattress.
Figure 4:
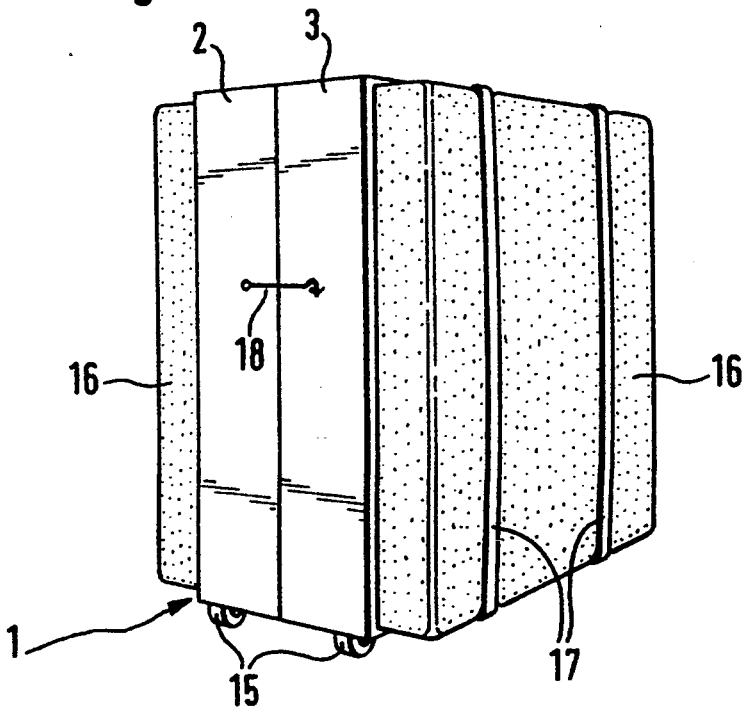
FIG. 4 is a perspective view of the folded bed in its transport position.

The bed frame is suited for a one-part continuous mattress, however this is more difficult to transport. Therefore it is particularly advantageous to use a two-part mattress, whereby each mattress element corresponds in size with an element 2, 3 of the bed frame 1. Such an embodiment of the bed is shown in FIG. 4 in folded state positioned on casters 15. The two elements 2, 3 are folded together with their undersides facing each other, whereby the legs 14 disappear into the hollow space created by the undersides of elements 2, 3. On the outside of elements 2, 3 are the mattress elements 16 of a two-part mattress 11, which are kept in place there by straps 17. The straps 17 can be suspended in eyelets which, as shown in FIG. 3, are attached to the long sides 5 by short bands. A latch 18 connects elements 2, 3 on their sides opposite to the hinges 4, so that a stable, box-like body results, which has advantageous transport dimensions and can be easily moved on pivotable casters 15. This construction of the described bed is mainly suited as an additional bed in the hotel business, since it can be easily transported and set up by a single person.

In order to install the bed it is merely necessary to release the latch 18 and to roll apart the elements 2, 3 on their casters with their frontal sides 6, until their long sides 5 are in one line. Subsequently the bed unfolded this way is tilted sideways, until it comes to stand on its legs 14. Since each of the two elements 2, 3 is provided with four legs, a stable arrangement is formed, which can be subjected to strong demands. The hinges 14 are largely not subjected to load and serve primarily for the correct alignment and positioning of the two elements 2, 3 with respect to each other. The straps 17 are released after the bed had been set up and can be kept underneath the mattress or in a pocket provided on the underside of the bed. The folding of the bed takes place in reverse order and is just as simple.

In addition to the described embodiment examples, other embodiments of the bed according to the invention are conceivable. So for instance the hinges for the connection of the two elements 2, 3 can be designed so that they are suited for the transfer of the load to be absorbed by one element to the other element, so that the one element can be held by means of the hinge by the other element and needs legs only at its end facing away from the hinge. Also other means can be provided by which one element can be supported by the other element in the unfolded state.

I claim:

1. A folding bed comprising:

a rectangular frame bed stand having a symmetry plane and including a pair of substantially symmetrical halves, each of the halves comprising:

a respective pair of spaced apart outer and inner narrow sides, the narrow inner side lying along symmetry planer a respective pair of elongated sides bridging the narrow sides, and at least one respective swingable caster mounted on at least one of the elongated sides;

hinge means for pivotally interconnecting the inner sides of the halves to fold the bed stand from a use position corresponding to the respective elongated sides of the halves aligned with one another to a transport position corresponding to the halves face one another; and a mattress mounted on the bed stand and foldable therewith, the bed stand along with the mattress being movable in the transport position on the casters.

2. The folding bed defined in claim 1 wherein the bed stand has a plurality of intermediate positions between the use and transport positions.

3. The folding bed defined in claim 1 wherein one of the outer narrow sides is provided with a latch for locking the halves in the transport position.

4. The folding bed defined in claim 1 wherein each of the halves further includes a respective plurality of legs, the legs of one of the halves being staggered with respect to the legs of the other half, so the legs of one the halves lie next to the legs of the other half in the transport position.

5. The folding bed defined in claim 1 wherein the bed stand further includes braces at neighboring parts of said elongated sides of the halves in the use position.

6. The folding bed defined in claim 1 wherein the elongated sides of each of the halves is formed with respective spaced apart slats forming a support for the mattress.

7. The folding bed defined in claim 1 wherein the mattress is a two-part foldable mattress.

8. The folding bed defined in claim 7, further comprising at least a plurality of straps fastening the two-part mattress to respective halves of the bed stand.

9. The folding bed defined in claim 1 wherein the bed stand further includes a carrying handle mounted on at least one of the narrow sides.

* * * * *